United States Patent [19]

Inenaga et al.

[11] 3,967,688

[45] July 6, 1976

[54] FUEL INJECTION DEVICE FOR AN IMPACT ATOMIZATION-TYPE DIESEL PILE HAMMER

[75] Inventors: Noriyasu Inenaga; Mataji Tateishi, both of Nagasaki, Japan

[73] Assignee: Mitsubishi Jukogyo Kabushiki Kaisha, Tokyo, Japan

[22] Filed: June 2, 1975

[21] Appl. No.: 582,932

Related U.S. Application Data

[62] Division of Ser. No. 497,118, Aug. 12, 1974.

[30] Foreign Application Priority Data

Aug. 14, 1973 Japan ..... 48-90527

[52] U.S. Cl. ..... 173/137; 123/46 H; 123/46 SC; 239/488

[51] Int. Cl.[2] ..... E02D 7/12

[58] Field of Search ..... 173/135–137, 173/127; 123/46 H; 239/487, 488

[56] References Cited

UNITED STATES PATENTS

| | | | |
|---|---|---|---|
| 1,095,134 | 4/1914 | Wright | 239/488 X |
| 1,319,527 | 10/1919 | Kreuzhage | 239/488 X |
| 2,068,593 | 1/1937 | Bork | 239/488 X |
| 2,740,385 | 4/1956 | Haage | 173/135 X |
| 3,679,005 | 7/1972 | Inaba et al. | 173/137 X |

FOREIGN PATENTS OR APPLICATIONS

| | | | |
|---|---|---|---|
| 699,981 | 8/1932 | France | 239/488 |

*Primary Examiner*—Ernest R. Purser
*Attorney, Agent, or Firm*—Cushman, Darby & Cushman

[57] ABSTRACT

The nozzle is provided with a bar which may be rotated to and fixed at various angular positions. The bar has a longitudinally extensive cut away portion, providing a fuel passage. Varying the angular position changes the turning velocity of the vortex-type jet issuing from the passage. The effect of varying the shape of the fuel passage is also described. The purpose of variation is to cause fuel to be properly retained on the saucer shaped top surface of the impact block until the piston strikes the surface, causing the fuel to atomize and be uniformly dispersed to enhance complete combustion of the fuel.

4 Claims, 19 Drawing Figures

FUEL INJECTION DEVICE FOR AN IMPACT ATOMIZATION-TYPE DIESEL PILE HAMMER

This is a division of application Ser. No. 497,118, filed Aug. 12, 1974.

BACKGROUND OF THE INVENTION

In Diesel pile hammers, such as the conventional one shown in FIG. 1, the piston (1) during its free descent in the cylinder (2), pushes a cam lever (3) facing on the inside of said cylinder (2) at the fuel pump attached to the cylinder whereby the cam lever pushes down a plunger (4) at its end to close the fueling port (7) in the pump chamber (5) connected to the fuel tank (6) thereby to produce compressed state within the pump chamber (5). When the pressure in the pump chamber (5) has risen above the opening pressure for the delivery valve (8), the fuel in the pump chamber (5) pushes the delivery valve open and is sprayed through a nozzle (9) onto the part-spherical saucer (11) formed on the top of the impact block (10) which is riding on the pile head. Because the opening pressure for said delivery valve (8) is very low and the delivery valve (8) provides a restriction, the fuel sprayed from the nozzle (9) is not at all atomized but remain as liquid on the saucer (11).

As the piston (1) further goes down, it closes the suction and exhaust port (12), thus producing a compressed state of high temperature and pressure within the cylinder. When the lower end of the piston (1) strikes the saucer (11) of the impact block (10), the fuel which has been deposited on the saucer (11) gets atomized and scattered by the impact. The particles of fuel scattered in the combustion chamber formed by the piston (1), saucer (11) and cylinder (2) will ignite and burn spontaneously under the ambient high temperature and pressure. This results in further increase in temperature and pressure in the combustion chamber, so the piston (1) is raised upward under the high gaseous pressure in the cylinder (2), discharging the combustion gas through the suction and exhaust port (12). With further ascent of the piston (1) in the cylinder (2), fresh air is induced through said suction and exhaust port (12) into the cylinder (2). The cycle is completed when the piston (1) rises up to the original point in the cylinder (2).

In this conventional Diesel pile hammer, however, the fuel spouting from the nozzle (9) and striking the saucer (11), does not all rest on the saucer but about half of the total amount of the fuel spouted may spill away-from the saucer, with the result that the spilled fuel will not receive any impact to atomize it but will remain deposited on the inner wall of the cylinder (2) without burning.

Consequently, the fuel that contributes to effective combustion is only half of the spouted quantity and even this fuel is maldistributed in the saucer so that it is distributed uniformly throughout the combustion chamber by impact. The result is that the fuel deposited on the inner wall of the cylinder (2) will flow out as unreacted fuel vapor through the suction and exhaust port thus becoming the cause for white smoke, while the fuel unevenly distributed upon the impact in combustion chamber will undergo an imperfect combustion due to local air shortage thus becoming the cause for black smoke.

It is thus seen that the conventional Diesel pile hammer has the disadvantage of causing much smoke, resulting from imperfect combustion because of inadequacy in feeding fuel to the saucer formed on the top of the impact block.

SUMMARY OF THE INVENTION

The present invention has been devised to eliminate such disadvantage.

The invention relates to a fuel injection device for a Diesel pile hammer including a rotatable bar mounted rotatively in the body of the fuel injection pump for the Diesel pile hammer and having a portion of its outer peripheral surface cut-away to form a fuel passage whereby to obtain a vertical jet of fuel with a desired turning speed according to the angular position or shape of the rotatable bar and the cut-away section.

As mentioned above, the conventional fuel injector in a Diesel pile hammer has the disadvantage that about 50 percent of the total fuel injected will spill out of the saucer and even for fuel-stored in saucer the distribution of fuel particles upon impact is not uniform in combustion chamber. In order to correct for such defect, the present invention provides, as stated above, a rotatable bar mounted rotatably in the body of the fuel injection nozzle which has cut away a portion of its surface to form a fuel passage of a desired shape whereby a fuel jet of vortex type be producted in order to decrease the speed of spouting fuel in the direction of fuel injection to decrease the speed of the jet as it strikes the saucer. Also in accordance with the invention, rotation of said rotatable bar or selection of the shape of its cut-away portion provides for obtaining a fuel jet with a desired turning speed to achieve the function expected.

The principles of the invention will be further hereinafter discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

IN THE DRAWINGS

Figure 1:
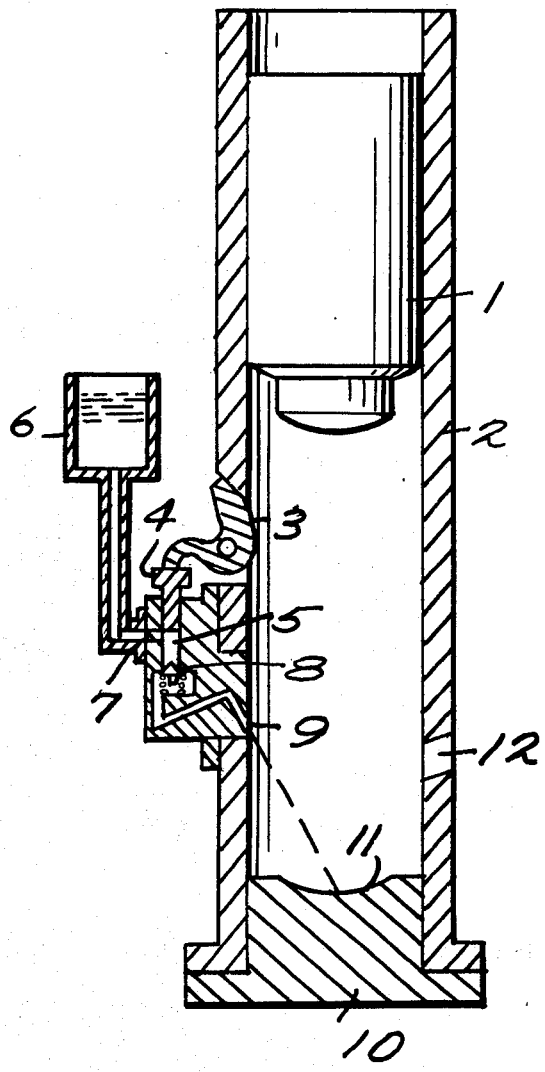
Fig. 1. PRIOR ART
Figure 2A:
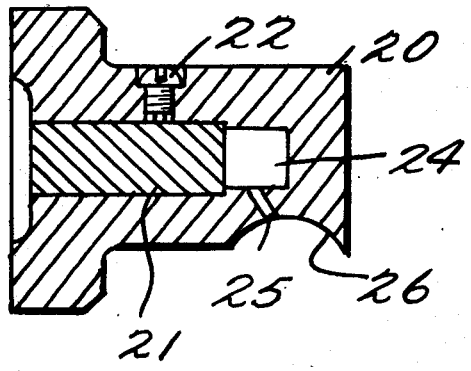
Figure 2B:
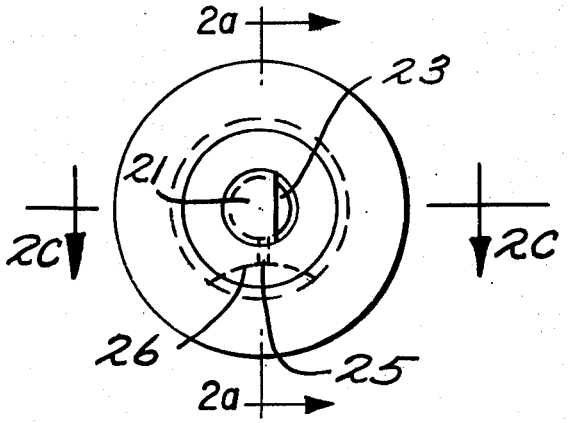

FIG. 1 is a longitudinal sectional view of an impact atomization-type diesel pile hammer provided with a conventional fuel injector;

FIG. 2*a* is a longitudinal sectional view of a fuel injector embodying principles of the present invention, on line II*a*—II*a* of FIG. 2*b;*

Figure 2C:
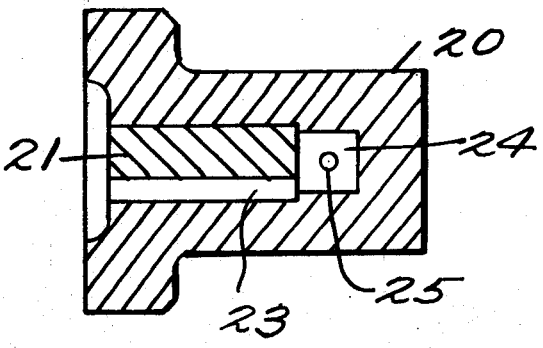

FIG. 2*b* is an upstream end view thereof;

FIG. 2*c* is a longitudinal sectional view on line II*c*—II*c* of FIG. 2*b;*

FIGS. 3*a* through 3*g* are seven transverse cros-sectional views of respective variations of the rotatable bar of the fuel injector of FIGS. 2*a*–2*c*, each bar shown having a cut-away portion of different shape. The outline of the fuel passage defined in conjunction with the nozzle body in which the bar is received is also shown in each view.

Figure 4A:
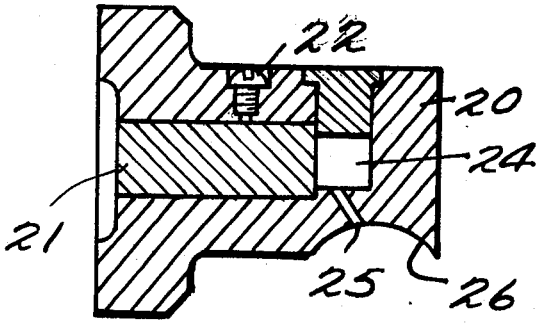
Figure 4B:
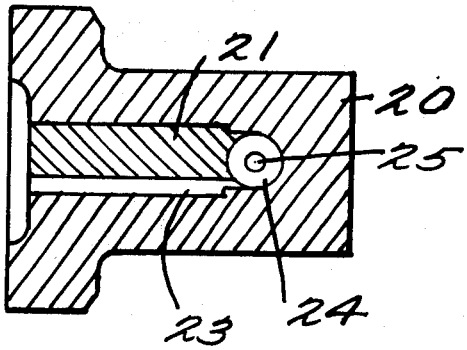
Figure 5:
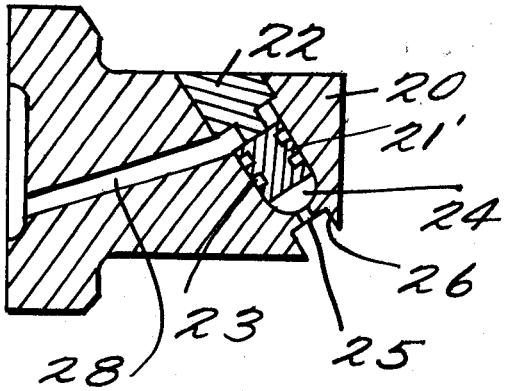
Figure 6:
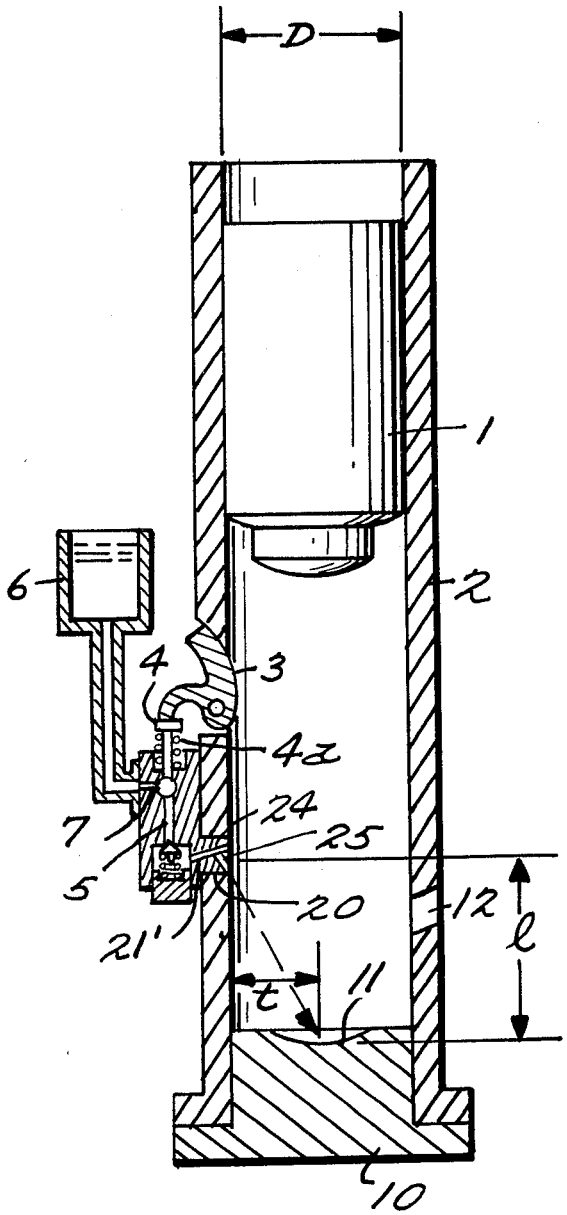
Figure 7A:
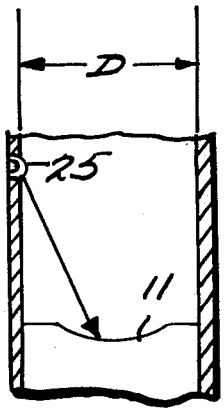
Figure 7B:
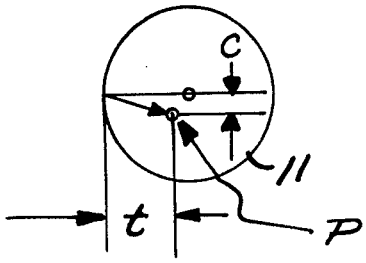
Figure 8:
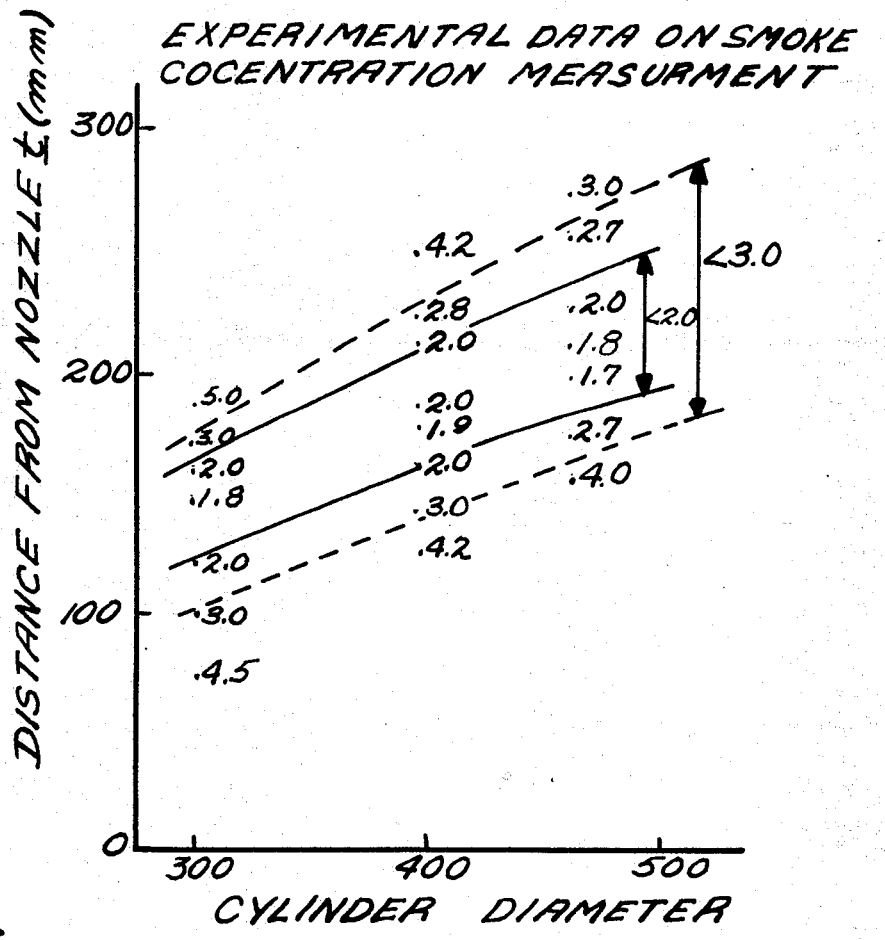
Figure 9:
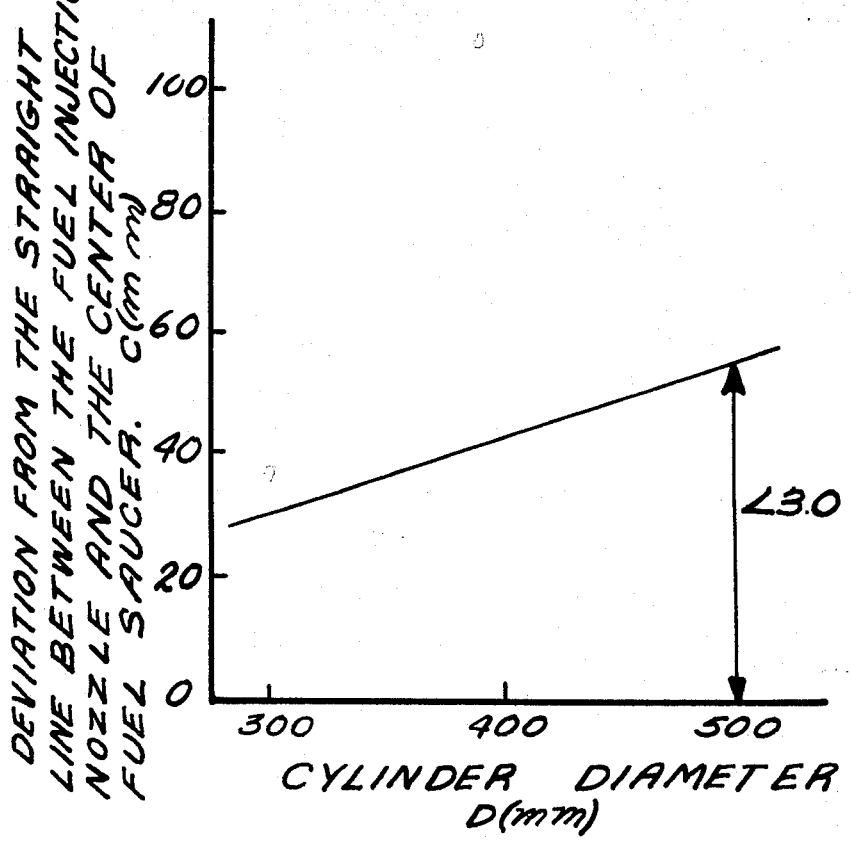

FIGS. 4*a* and 4*b* are longitudinal sectional views, comparing respectively with FIGS. 2*a* and 2*c*, of another embodiment of the fuel injector;

FIG. 5 is a longitudinal sectional view, comparing with FIGS. 2*a* and 4*a* of another embodiment of the fuel injector, wherein the cut-away portion of the pin is helical;

FIG. 6 is a longitudinal sectional view of an impact atomization-type diesel pile hammer provided with a fuel pump having an injector nozzle embodying the principles of the present invention;

FIG. 7*a* is a fragmentary longitudinal sectional view of the region of the diesel pile hammer chamber where fuel is injected onto the saucer, showing fuel being injected;

FIG. 7*b* is a plan view of the saucer, showing fuel being injected to impinge at point P thereon;

FIG. 8 is a plot of experimental data relating the effect of cylinder diameter D and the distance *t* (of FIG. 7*b*) upon smoke concentration $\epsilon$ as measured with a Bosch smoke meter; and FIG. 9 is a plot of experimental data relating the effect of cylinder diameter D and the distance C (of FIG. 7*b*) upon smoke concentration $\epsilon$ as measured with a Bosch smoke meter.

DETAILED DESCRIPTION

In FIGS. 2*a*–2*c*, the nozzle body 20 is shown provided with a cylindrical socket whose inner end region 24 constitutes a vortex chamber. A round bar 21 is received in the socket for rotation about its own longitudinal axis. The bar 21 has an outer peripheral section cut away along its whole length, so that the resulting surface, in cooperation with the inner peripheral surface of the socket, provides a fuel passage 23 extending from the upstream end of the nozzle body to the vortex chamber 24.

Means are provided for fixing the angular position of the bar 21 relative to the nozzle body 20. In the instance shown, this means takes the form of a set screw 22 laterally threadably received in the nozzle body so that when the screw is loosened the bar may be turned and when the screw is tightened, its inner end impinges on the bar to fix the angular position of the bar.

The nozzle body is shown provided on its exterior, adjacent the vortex chamber, with a concave recess 26 which provides a restricting guide for the fuel jet. A nozzle opening 25 extends from the recess 26 to the vortex chamber 24.

Figure 3A:
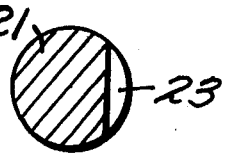
Figure 3B:
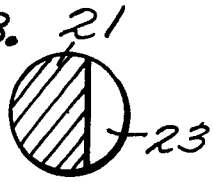
Figure 3C:
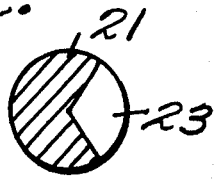
Figure 3D:
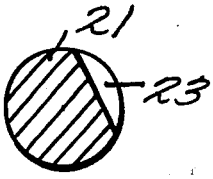
Figure 3E:
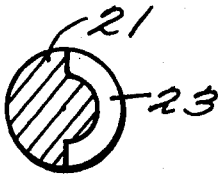
Figure 3F:
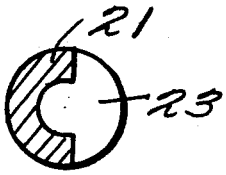
Figure 3G:
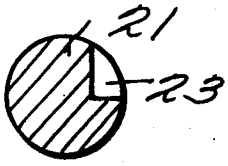

In FIG. 3*a* there is depicted a transverse cross-section of the bar 21 of FIGS. 2*a*–2*c*, and the outline of the socket in the nozzle body to show the transverse cross-sectional shape of the fuel passage 23.

FIGS. 3*b*–3*g* show other, typical cross-sections of bar 21 and fuel passage 23.

As illustrated in FIGS. 4*a* and 4*c*, the vortex chamber 24 may have a longitudinal axis at right angles to that of the socket in which the bar 21 is rotatably received, instead of being formed as a coaxial extension thereof as in the case in FIGS. 2*a*–2*c*.

In fact, the cut-away portion of the bar 21 need not extend straightly along one side of the bar, but may be helical as shown at 21' in FIG. 5. In this embodiment the helical nature of the passage 23 affects the turning speed of the fuel vortex. After the angular disposition of the bar 21' has been selected, the set screw 22 may be tightened to fix the bar with respect to the nozzle body 20.

FIG. 6 shows the fuel injection nozzle of the vortex-type shown in FIG. 2*a*, 2*b*, 2*c* as it is incorporated in the pump of a diesel pile hammer. In the Figure the numerals (4*a*) and (8) show the springs of a plunger (4) and a delivery valve (8), respectively. Numerals designating elements shown in FIG. 1 are also provided in FIG. 6.

During the free descent in the cylinder (2), the piston pushes a cam lever (3) of the fuel pump attached to the cylinder (2), which in turn pushes down a plunger (4) against the action of a spring (4*a*) to close the fuel port (7) of the pump chamber (5) communicating with the fuel tank (6) so as to make a compressed state in the pump chamber (5). When the pressure in the pump chamber (5) rises above the opening pressure for the delivery valve (8), the fuel in the pump chamber (5) pushes the delivery valve (8) open and goes through a fuel passage into a vertical chamber (24) where the fuel makes a turning motion and is injected through the nozzle (25) to form a conical jet.

The velocity of this conical jet when it strikes the saucer (11) is small and in spite of the low injection pressure the jet becomes relatively well atomized, which together with the small momentum of fuel drops, permits an effective deceleration of fuel due to the friction of the surface of the saucer (11) so that the fuel will stay uniformly over the surface of the saucer.

The fuel which has not flowed onto the saucer (11) will be wafted uniformly within the cylinder (2) since it is atomized at the outset.

As the piston goes further downward in the cylinder (2) it closes the suction and exhaust port (12), thus producing a compressed state of high temperature and high pressure within the cylinder (2). So some of the fuel mist wafted in the cylinder (2) will be gasified.

The piston (1) then strikes the saucer (11), whereupon the fuel on the saucer (11) will be distributed uniformly as mist in the combustion chamber formed by the piston (1), cylinder (2) and saucer (11), will ignite immediately due to the high temperature and pressure in the combustion chamber, thereby inducing a rapid combustion of the wafted fuel which is atomized and evenly distributed by impact and make perfectly combusted.

This brings the interior of the combustion chamber to higher temperature and pressure and the piston (1) goes upward due to the pressure of the gas in the cylinder. During this upward stroke of the piston, exhaust gas is discharged through the suction and exhaust port (12) and then fresh air is induced through said suction and exhaust port (12) in cylinder (2).

Thereafter the piston will stop at a position in the cylinder (2) balancing the combustion energy to complete its cycle.

It is understood that the fuel injection device illustrated in the drawings enables the provision of a diesel pile hammer wherein the spilling of injected fuel out of the saucer (11) as in the prior art may be prevented and all wherein the spilling of injected fuel burns completely in an instant so that the cycle efficiency can be enhanced without producing smoke.

In the fuel injection device of the diesel pile hammer shown in FIG. 4, there must be a point most suitable for combustion among the possible geometric points of impingment on the saucer (11) of the conical fuel jet from the injection nozzle (25). FIGS. 7–9 show this fact. FIGS. 8 and 9 indicate the result of the measurement with a Bosch smoke meter of the concentration of the exhaust smoke-after combustion for the fuel injection devices of vortex-type to diesel pile hammers having different cylinder diameters.

More specifically, in FIGS. 7*b* and 8, *t* denotes the distance form the nozzle hole (25) of fuel injection device to the geometric point of impingement upon the saucer (11) of the conical jet as measured in parallel with the projection of the straight line connecting between the nozzle and the center of the saucer (11), and the deviation of said point of impingement from the center of the saucer is represented in FIGS. 7*b* and 9 by the minimum distance C (in mm) over the smoke concentration $\epsilon$ measured with a Bosch smoke meter.

In FIG. 8 it is considered that a good combustion is given if the concentration of smoke $\epsilon \leq 3.0$, and therefore the vertical nozzle which satisfies the condition that $\epsilon \leq 3.0$, and has a relative relation with between the saucer and nozzle as shown in FIG. 8 may be said to be suitable as a nozzle for the diesel pile hammer.

It is seen from FIG. 8 that the range of $t$ satisfying $\epsilon \leq 3.0$.

$$\frac{40}{100}D - 20 \leq t \leq \frac{60}{100}D \qquad (1)$$

As to C, on the other hand, it is recognized from a similar experimental result that within the range shown by formula (1), $\epsilon \leq 3.0$ is satisfied for the value of C within a range as shown in FIG. 9.

It follows from FIG. 9 that such range of the value of C is $$C \leq \frac{12.5}{100}D - 7.5$$

Thus it is also a fuel injection device for diesel pile hammers contemplated by the invention that is equipped with a nozzle of vortex-type as shown in FIGS. 2 to 4 and a conventional nozzle of vortex-type as shown in FIG. 5, wherein the relative relation between said nozzle and the saucer satisfies simultaneously the two conditions that $$\frac{40}{100}D - 20 \leq t \leq \frac{60}{100}D \text{ (in mm)},$$

and that $$C \leq \frac{12.5}{100}D - 7.5 \text{ (in mm)}$$

Although some embodiments of the invention have so far been described, it should be noted that the invention is not limited to such embodiments but various modified designs may be possible within the scope of the invention.

It should now be apparent that the fuel injection device for an impact atomization-type diesel pile hammer as described hereinabove posseses each of the attributes set forth in the specification under the heading "Summary of the Invention" hereinbefore. Because fuel injection device for an impact atomization-type diesel pile hammer of the invention can be modified to some extent without departing from the principles of the invention as they have been outlined and explained in this specification, the present invention should be understood as encompassing all such modifications as are within the spirit and scope of the following claims.

What is claimed is:

1. In a diesel pile hammer of the impact atomization type wherein a piston sliding in a cylinder periodically impacts a concave, fuel-receiving saucer provided on an impact block, a fuel injection device for periodically supplying a vertical stream of fuel impinging on the saucer, said fuel injection device comprising:

a nozzle body having means defining a socket therein, in communication with an upstream end thereof;

a bar received in the socket from said end for rotation about its own longitudinal axis, and the socket downstream of the bar defining a vortex chamber;

means for selectively fixing the angular disposition of the bar relative to the nozzle body;

said bar being relieved from along the length thereof to provide a fuel passage from the upstream end of the nozzle body to the vortex chamber, the outlet of said fuel passage into the vortex chamber being laterally displaced from the longitudinal axis of the bar so that rotation of the bar affects the spatial relation of said outlet to said vortex chamber; and, means defining a nozzle opening extending through the nozzle body from the vortex chamber for ejecting fuel from the vortex chamber;

the bar being so angularly oriented in the socket that both of the following conditions are simultaneously met:

$$\frac{40}{100}D - 20 \leq t \leq \frac{60}{100}D \qquad \text{(i)}$$

$$C \leq \frac{125}{100}D - 7.5, \qquad \text{(ii)}$$

wherein:

D is the cylinder diameter (in mm);

$t$ is the distance (in mm) from the injection nozzle to the geometrical point of impingement of the fuel on the saucer, measured in parallel with a horizontal projection of an imaginary straight line connecting the injection nozzle and the geometric center of the saucer; and, C is the deviation (in mm) of the geometrical point of impingement of the fuel on the saucer from the center of the saucer as represented by the minimum distance from a horizontal projection of an imaginary straight line connecting the injection nozzle and the geometric center of the saucer.

2. In a diesel pile hammer of the impact atomization type wherein a piston sliding in a cylinder periodically impacts a concave, fuel-receiving saucer provided on an impact block, a fuel injection device for periodically supplying a vortical stream of fuel impinging on the saucer, said fuel injection device comprising:

a nozzle body having means defining a socket therein, a communication with an upstream end thereof;

a bar received in the socket from said end for rotation about its own longitudinal axis, and the socket downstream of the bar defining a vortex chamber;

means for selectively fixing the angular disposition of the bar relative to the nozzle body;

said bar being relieved from along the length thereof to provide a fuel passage from the upstream end of the nozzle body to the vortex chamber, the outlet of said fuel passage into the vortex chamber being laterally displaced from the longitudinal axis of the bar so that rotation of the bar affects the spatial relation of said outlet to said vortex chamber; and, means defining a nozzle opening extending through the nozzle body from the vortex chamber for ejecting fuel from the vortex chamber;

the bar being so angularly oriented in the socket that both of the following conditions are simultaneously met:

$$\frac{40}{100}D - 20 \leq t \leq \frac{60}{100}D \qquad \text{(i)}$$

$$C \leq \frac{125}{100}D - 7.5, \qquad \text{(ii)}$$

wherein:

D is the cylinder diameter (in mm);

$t$ is the distance (in mm) from the injection nozzle to the geometrical point of impingement of the fuel on the saucer, measured in parallel with a horizontal projection of an imaginary straight line connecting the injection nozzle and the geometric center of the saucer; and, C is the deviation (in mm) of the geometrical point of impingement of the fuel on the saucer from the center of the saucer as represented by the minimum distance from a horizontal projection of an imaginary straight line connecting the injection nozzle and the geometric center of the saucer.

3. The diesel pile hammer of claim 1 wherein a portion of the outer peripheral surface of the bar is relieved to provide said fuel passage in cooperation with said socket.

4. The diesel pile hammer of claim 3 wherein the relieved portion is helical.

* * * * *